US007887392B2

(12) United States Patent
Franzen

(10) Patent No.: US 7,887,392 B2
(45) Date of Patent: Feb. 15, 2011

(54) PLATEN ASSEMBLY AND WORK PIECE CARRIER HEAD EMPLOYING FLEXIBLE CIRCUIT SENSOR

(75) Inventor: Paul M. Franzen, West Linn, OR (US)

(73) Assignee: Novellus Systems, Inc., San Jose, CA (US)

( * ) Notice: Subject to any disclaimer, the term of this patent is extended or adjusted under 35 U.S.C. 154(b) by 400 days.

(21) Appl. No.: 11/758,797

(22) Filed: Jun. 6, 2007

(65) Prior Publication Data

US 2008/0305717 A1 Dec. 11, 2008

(51) Int. Cl.
*B24B 49/00* (2006.01)

(52) U.S. Cl. ..... 451/8; 451/5; 451/290

(58) Field of Classification Search ..... 451/5, 451/7, 8, 41, 56, 285–290
See application file for complete search history.

(56) References Cited

U.S. PATENT DOCUMENTS 5,720,845 A * 2/1998 Liu ..... 438/692
5,944,580 A * 8/1999 Kim et al. ..... 451/9
6,257,953 B1 * 7/2001 Gitis et al. ..... 451/5
6,485,354 B1 * 11/2002 Wolf ..... 451/6
6,722,946 B2 * 4/2004 Talieh et al. ..... 451/8
6,780,085 B2 * 8/2004 Wolf ..... 451/6
7,097,538 B2 * 8/2006 Talieh et al. ..... 451/6
7,695,597 B1 * 4/2010 Drewery et al. ..... 204/242
2007/0032171 A1 * 2/2007 Chandrasekaran ..... 451/8
2007/0243794 A1 * 10/2007 Mundt ..... 451/5

* cited by examiner

*Primary Examiner*—Maurina Rachuba
(74) *Attorney, Agent, or Firm*—Ingrassia Fisher & Lorenz, P.C.

(57) ABSTRACT

A platen assembly is provided for supporting a polish pad of the type utilized to planarize a wafer. The platen assembly comprises a sensor system and a polish platen having a first surface for supporting the polish pad. The sensor system comprises a flexible sensor and a flexible circuit operatively coupled to the sensor controller. The flexible circuit includes a first flexible sensor disposed proximate the first surface.

16 Claims, 5 Drawing Sheets

PLATEN ASSEMBLY AND WORK PIECE CARRIER HEAD EMPLOYING FLEXIBLE CIRCUIT SENSOR

FIELD OF THE INVENTION

The present invention generally relates to a chemical mechanical planarization (CMP) apparatus and, more particularly, to a platen assembly and work piece carrier head each including at least one flexible sensor.

BACKGROUND OF THE INVENTION

Chemical mechanical polishing, also known as chemical mechanical planarization (referred to herein collectively as "CMP"), has been widely utilized for the planarization of semiconductor wafers. CMP produces a substantially smooth, planar face on one or more sides of a wafer. During CMP, an unprocessed wafer is typically first transferred to a work piece carrier head, which presses the wafer against a polish pad (or other polishing surface) supported by a platen assembly. Polishing slurry is introduced between the wafer's front surface and the polish pad, and relative motion (e.g., rotational, orbital, and/or linear) is initiated between the polish pad and the work piece carrier head. The mechanical abrasion of the polish pad and the chemical interaction of the slurry gradually remove topographical irregularities present on the wafer's front surface to produce a planar surface.

One known type of work piece carrier head comprises a housing having a flexible bladder coupled thereto, which contacts the back (i.e., the unpolished) surface of the wafer during polishing. The housing and the bladder cooperate to form a plurality of concentric pressure chambers or plenums behind the bladder. During CMP, the pressure within each of these plenums is independently adjusted to vary the force applied to the wafer's back surface by the bladder at different annular zones and consequently control the rate removal at different annular zones along the wafer's front surface. In this manner, the carrier head may compensate for topographical variations on wafer's front surface or other non-uniformities in the polishing process. For example, if a particular portion of wafer's front surface is determined to be relatively thick, the pressure within the corresponding plenum may be increased to intensify the rate of removal proximate the thicker area. Plenum pressure adjustments are typically performed by a closed-loop control (CLC) system, which may comprise a central CMP controller and a thickness measuring system.

To measure the thickness of the wafer during the polishing process, the CMP apparatus is typically equipped with a sensor system. One type of sensor system employs one or more eddy current probes, which induce and measure eddy currents in metal films indicative of the film thickness. Alternatively, the sensor system may employ optical probes that measure specific wavelengths of light in the visible spectrum, infrared, and/or ultraviolet spectrum to measure film thickness. The probes may be fixedly disposed within the platen assembly at different radial positions slightly below the polish pad. Each probe is electrically coupled to a sensor controller by way of a cable, which runs within a channel provided through the platen assembly. The sensor controller is operatively coupled to the central CMP controller and relays the film thickness readings thereto. The wafer readings are compiled to produce a topographical wafer map to which the central CMP controller may refer in determining appropriate plenum pressure adjustments.

Sensor systems of the type described above are limited in certain respects. For example, as each probe is fixedly disposed within the platen assembly, replacement or repair of a damaged probe may require disassembly of the entire platen assembly. Also, since each probe position is fixed, it can measure only a certain area of the wafer during processing. In addition, conventional sensor systems employ circuits supported by traditional printed circuit board (PCB) substrates, which may be damaged by vibrations produced during the CMP process. As another limitation, each probe is generally coupled to the sensor controller by way of a separate connector cable, which runs within a channel through the platen assembly. Each of these channels provides a potential leak path for polishing slurry and represents an unsupported region of the polish pad, which may dimple (i.e., become depressed) and lead to a non-uniform polishing. Finally, conventional sensor systems may be unable to measure other characteristics of the CMP polishing process (e.g., temperature, polish pressure, etc.) in addition to film thickness.

In view of the above, it should be appreciated that it would be desirable to provide a sensor system of the type employed in a platen assembly (or a work piece carried head) that overcomes the limitations associated with known sensor systems. Ideally, such a sensor system would employ at least one sensor capable of measuring the thickness of the film or wafer, which is vibration resistant and which could be replaced or repaired without disassembly of the platen assembly. If such sensor system employed multiple sensors, it would also be desirable if all of the sensors were coupled to the CMP controller via a single cable passing through a single channel through the platen assembly (thus minimizing the likelihood of slurry leakage and pad dimpling). Finally, it would be desirable if such a sensor system were capable of measuring characteristics of the CMP polishing process in addition to, or in lieu of, film thickness. Other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements, and.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

As appearing herein, the term "flexible circuit," also referred to as "flex circuit" or "flexible electronic," is used in its broadest sense and includes any flexible sensor carried by a substrate having a pliability sufficient to withstand the process environment in the CMP apparatus. A non-exhaustive list of suitable substrates includes various plastics (e.g., polyimide film), metal films, and epoxy resin bonded glass fabrics (e.g., Flame Resistant 4). The "flexible circuit" may be single layer or multilayer and, if desired, may include stiffeners (e.g., polyimide glass, polyimide, FR-4, and various metals, such as copper and aluminum). Furthermore, the "flexible circuit" may be a hybrid circuit (referred to as a "rigid flex circuit") supported, in part, by a rigid substrate (e.g., epoxy glass, Flame Resistant 4). The "flexible circuit" may comprise any geometry or orientation. It may be planar, coiled, or shaped to follow the outline of a component.

Figure 1:
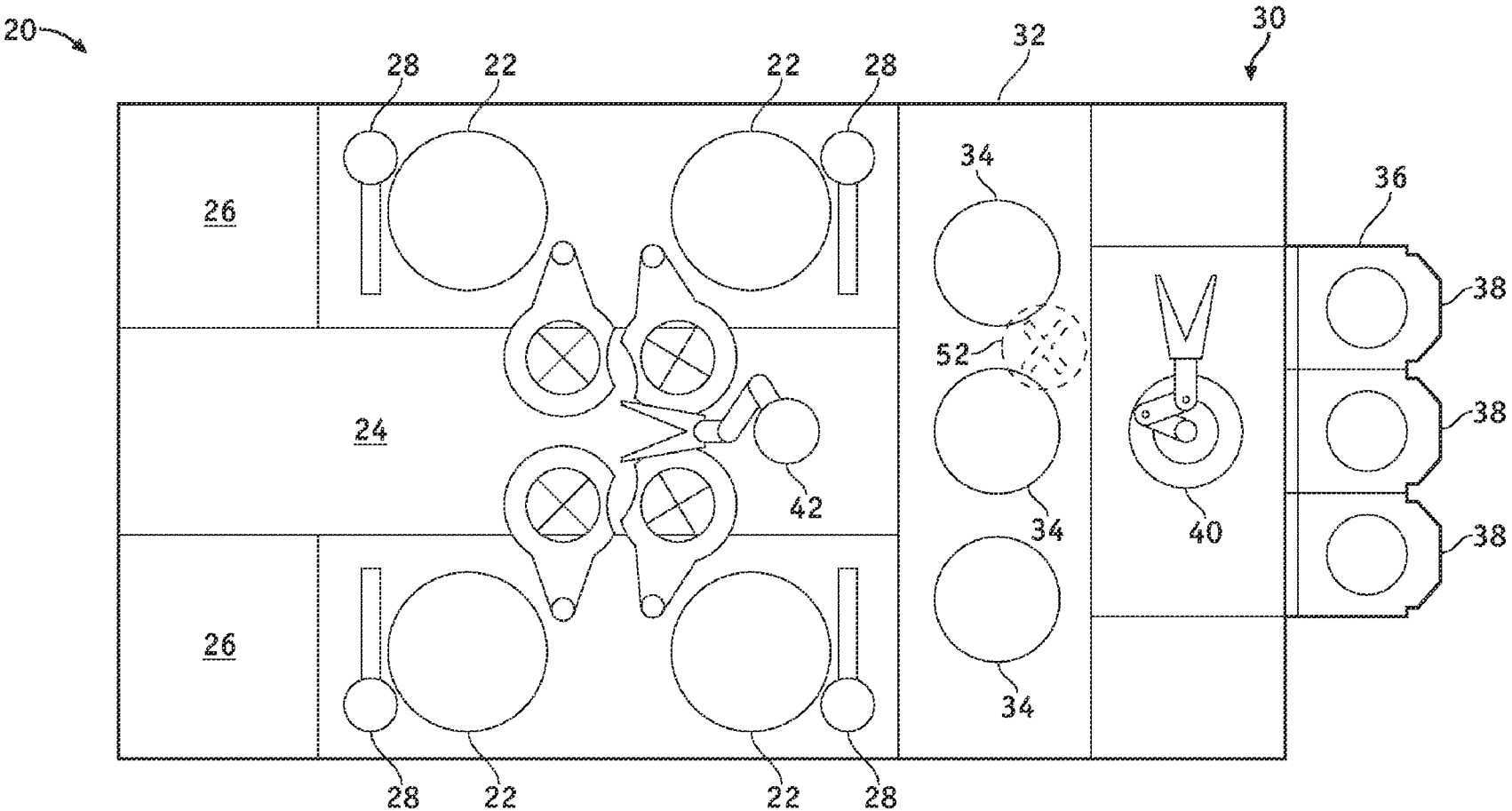
FIG. 1 is top functional view of an exemplary CMP apparatus.

FIG. 1 is a top functional view of an exemplary CMP apparatus 20 comprising a plurality of CMP systems 22, which are arranged in two rows and separated by a service access corridor 24. Electrical cabinets 26 may be disposed on either side of corridor 24 to provide storage space for electrical boards, controllers, and the like. CMP systems 22 each comprise a work piece carrier head and a polish assembly, which are described in detail below in conjunction with FIG. 2. Each polish pad is periodically conditioned by a pad conditioner 28, which may comprise an abrasive element attached to an arm configured to pivot from an off-pad location (illustrated) to a conditioning position in which the abrasive element sweeps across the polish pad.

A front end module 30 resides adjacent CMP systems 22 and opposite cabinets 26. Front end module 30 includes: (1) a cleaning module 32 having a plurality of cleaning stations 34 thereon, and (2) a wafer cache station 36 that accommodates a plurality of wafer caches 38. During the CMP process, unprocessed wafers are retrieved from wafer caches 38, cleaned at cleaning stations 34, and then planarized/polished by CMP systems 22. After planarization/polishing, the processed wafers may be transferred to cleaning stations 34 for post-planarization cleaning and subsequently returned to caches 38 by way of, for example, first and second transfer robots 40 and 42. During operation of CMP apparatus 20, first transfer robot 40 transfers selected wafers from caches 38 to a wafer handoff station 52 which resides on cleaning module 32 at a location accessible to both front end robot 40 and transfer robot 42 (e.g., underneath cleaning stations 34). Second transfer robot 42 then retrieves the wafer from handoff station 52, inverts the wafer so that its front surface is facing downward, and delivers the transferred wafer to a load cup associated with one of CMP systems 22. The CMP system 22 receiving the wafer subsequently planarizes the wafer's front surface in the manner described below.

Figure 2:
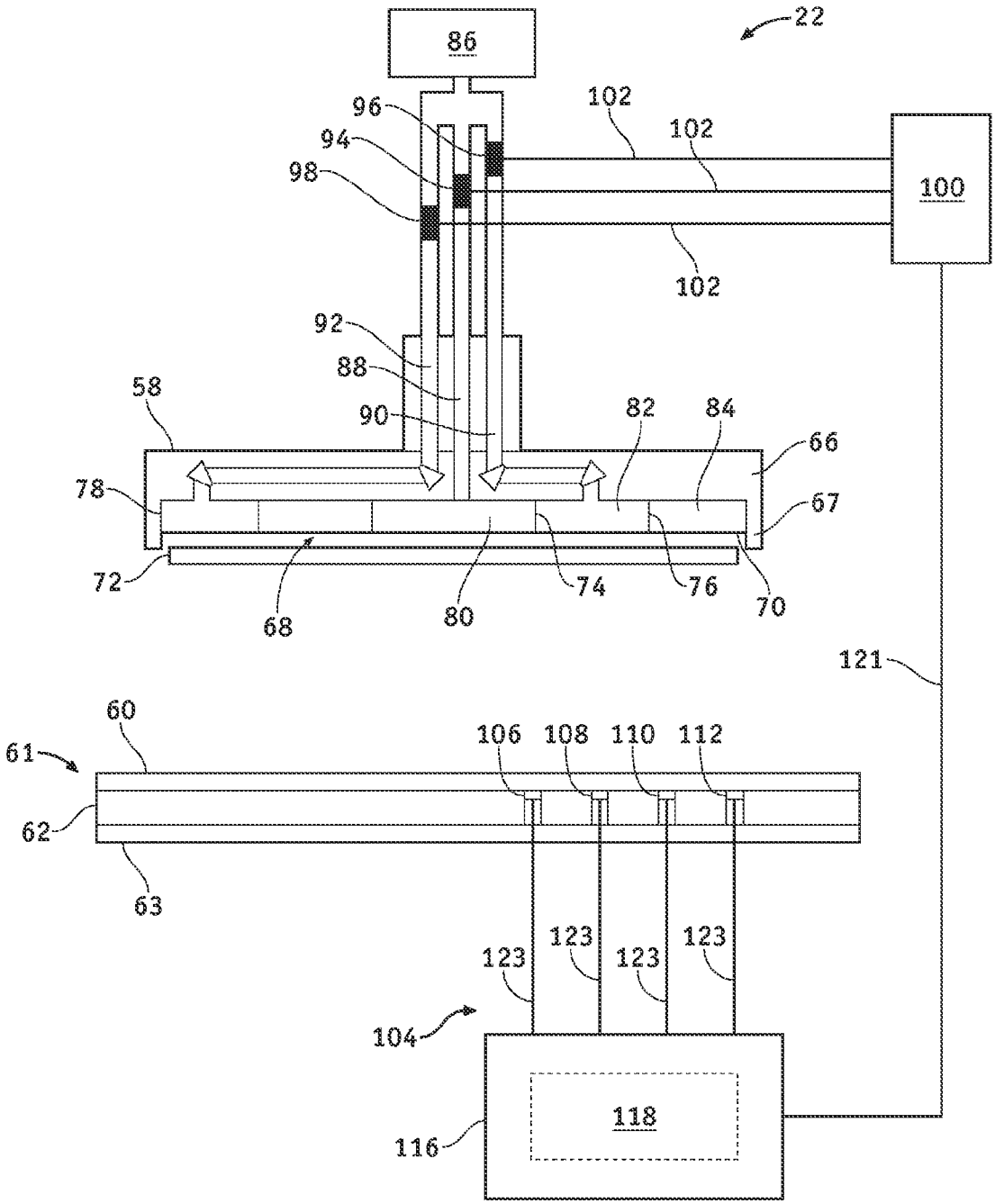
FIG. 2 is a cross-sectional view of one of the CMP systems shown in FIG. 1 in accordance with a first exemplary embodiment of the present invention.

FIG. 2 is a cross-sectional view of a CMP system 22, which may be employed by CMP apparatus 20 or by any other suitable CMP apparatus in accordance with a first exemplary embodiment of the present invention. CMP system 22 includes a work piece carrier head 58 and platen assembly 61. Carrier head 58 comprises a housing 66, a bladder 68 coupled to a lower portion of housing 66, and a retaining ring 67. Retaining ring 67 is attached to a lower peripheral portion of housing 66 and encircles bladder 68. Bladder 68 includes a flexible diaphragm 70, which contacts the back surface of a wafer 72 to force the front surface of wafer 72 against polish pad 60. A plurality of annular ribs extends from diaphragm 70. In the illustrated embodiment, three such ribs extend from diaphragm 70: an inner annular rib 74, an intermediate annular rib 76, and an outer annular rib 78. Ribs 74, 76, and 78 are sealingly coupled to carrier housing 66 to form a plurality of concentric pressure chambers or plenums within the carrier head 58; i.e., an inner plenum 80, an intermediate plenum 82, and an outer plenum 84. The pressure within each of these plenums may be independently adjusted to control the force exerted by diaphragm 70 on the back surface of wafer 72.

To permit the pressure within plenums 80, 82, and 84 to be independently adjusted, CMP system 22 includes a plurality of pneumatic passages that extends through carrier head 58 and that fluidly couples each of plenums 80, 82, and 84 to a fluid supply 86. For example, CMP system 22 may include three such pneumatic passages (i.e., passages 88, 90, and 92), which enable fluid communication with plenums 80, 82, and 84, respectively. Pressure regulators 94, 96, and 98 are fluidly coupled to respective pneumatic passages 88, 90, and 92. A central CMP controller 100 is operatively coupled to each of pressure regulators 94, 96, and 98 by way of a plurality of communication lines 102. CMP controller 100 utilizes regulators 94, 96, and 98 to control the pressure in plenums 80, 82, and 84, respectively. By regulating plenum pressure in this manner, CMP controller 100 may control the pressure exerted by diaphragm 70 on the back surface of wafer 72 and, consequently, the rate of removal along different regions (e.g., annular bands) of the front surface of wafer 72. If, for example, CMP controller 100 commands regulator 98 to increase the pressure in outer plenum 84, diaphragm 70 will exert a greater downward force along an outer annular band across the back surface of wafer 72, which will result in an increase in the rate of removal along an outer annular band on the front surface of wafer 72.

As indicated above, CMP apparatus 56 comprises a platen assembly 61, which includes a polish pad 60, a polish platen 62 and, perhaps, a bell 63. Other embodiments may include a manifold assembly used to delivery slurry through the platen and polish pad to the surface of the pad. Platen assembly 61 also includes a sensor system 104, which continually provides CMP controller 100 with measurements indicative of at least one characteristic of the CMP process. For example, sensor system 104 may monitor the film thickness of various regions of wafer 72 during the CMP process. Sensor system 104 may report the thickness measurements to CMP controller 100, which, in turn, may compile the thickness measurements to produce a topographical wafer map. CMP controller 100 may refer to this topographical map to determine appropriate plenum pressure adjustments.

Sensor system 104 includes at least one flexible circuit. In the illustrated exemplary embodiment, four independent flexible circuits are shown (i.e., circuits 106, 108, 110, and 112). Each of circuits 106, 108, 110, and 112 include one or more flexible circuits, which are adapted to measure at least one characteristic of the CMP process as indicated above. For example, circuits 106, 108, 110, and 112 may each include a flexible coil configured to induce and record eddy currents within wafer 72, which are indicative of film thickness. In other embodiments, the circuits may each include a flexible sensor used to measure pressure, temperature, and/or other process characteristics as described below. Flexible coils suitable for employment within circuits 106, 108, 110, and 112 are known and may be, for example, a wound-wire or etched coil supported by (e.g., bonded to or encapsulated within) a flexible substrate (e.g., a plastic film, a metal film, an epoxy resin bonded glass fabric, etc.).

Flexible circuits 106, 108, 110, and 112 are each operatively coupled to a sensor controller 116 by way of a cable 123. Sensor controller 116 is, in turn, coupled to CMP controller 100 by way of a communication line 121. Sensor controller 116 may include a drive system 118 and an amplifier (not shown), which may or may not be mounted to bell 63. During the operation of sensor system 104, the drive system 118 causes flexible circuits 106, 108, 110, and 112 to induce eddy currents within wafer 72. The induced eddy currents are then measured by circuits 106, 108, 110, and 112 and reported to sensor controller 116, which assigns each of the recorded thickness measurements a different radial position. The thickness measurements are then compiled to produce a wafer map, which may be referred to by CMP controller 100 in determining appropriate plenum pressure adjustments.

Flexible circuits 106, 108, 110, and 112 are disposed in platen 62 proximate the underside of pad 60 at different radial locations. In this manner, flexible circuits 106, 108, 110, and 112 may each collect data points from different concentric annular bands on the front surface of wafer 72. If CMP system 22 utilizes an orbital polishing motion, each flexible coil employed by flexible circuit 106, 108, 110, and 112 may monitor a single annular region during polishing, which may overlap with neighboring regions to provide redundancy. However, it should be appreciated that the location and number of flexible coils may be varied to suit a particular CMP system (e.g., a CMP system employing a linear, rotational, or other polishing motion).

Figure 3:
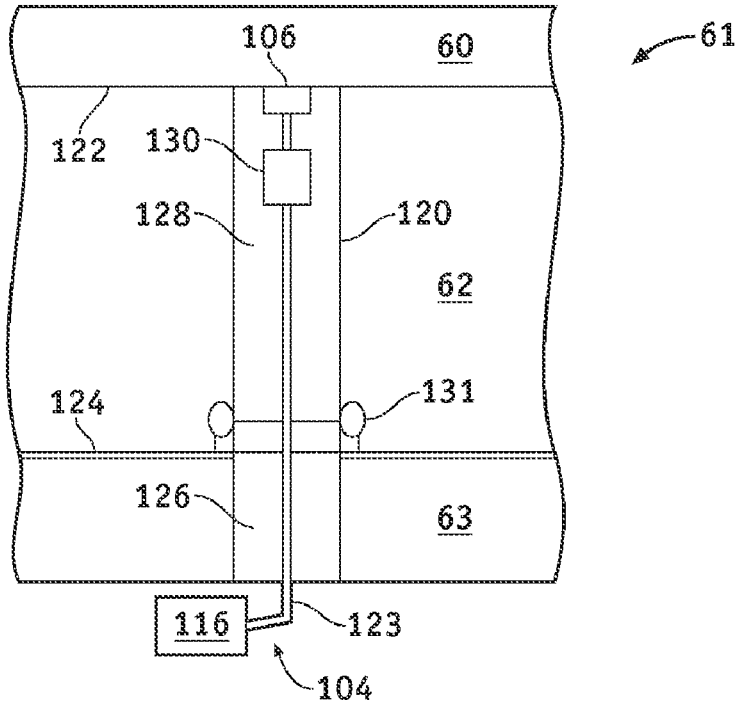
FIG. 3 is a detailed cross-sectional view of a portion of the platen assembly of the CMP system shown in FIG. 2.

FIG. 3 is a cross-sectional view of a section of platen assembly 61 illustrating sensor system 104 in greater detail. In this view, it may be seen that flexible circuit 106 is disposed proximate to polish pad 60; e.g., flexible circuit 106 may be adhesively attached to the underside of pad 60, or circuit 106 may be adhesively attached to polish platen 62. In one option, flexible circuit 106 resides within a channel 120, which extends from a lower surface 124 of platen 62 to the upper support surface 122 of platen 62. A similar channel 126 is also provided through manifold, if present, and the bell 63. Channels 120 and 126 permit cable 123 to pass through platen 62 and bell 63, respectively, and couple flexible circuit 106 to sensor controller 116 (FIG. 2). A collar 128 may reside within channel 120 and guide cable 123 therethrough. To decrease the likelihood of leakage, a seal (e.g., an o-ring 131) may be disposed between collar 128 and the inner surface of channel 120 in the manner shown in FIG. 3.

Cable 123 may include a connector 130 (e.g., a conventional multi-pin or finger connector), which permits flexible circuit 106 to be physically detached from sensor controller 116. When polish pad 60 is removed, flexible circuit 106 may be accessed. For example, if flexible circuit 106 is adhesively attached to the underside of polish pad 60, a technician may first peal pad 60 from support surface 122 of platen 62, reach underneath pad 60, and remove flexible circuit 106 therefrom. The technician may then disconnect connector 130 to physically detach flexible circuit 106 from sensor controller 116. In this manner, circuit 106 may easily be repaired or replaced without requiring disassembly of platen assembly 61.

While, in the foregoing description, flexible circuits 106, 108, 110, and 112 have been described as each including a flexible coil configured to measure the thickness of the film on wafer 72, it should be appreciated that circuits 106, 108, 110, and 112 may include any flexible sensor capable of measuring one or more characteristics of the CMP process. These characteristics include, but are not limited to: (1) film thickness, (2) temperature, (3) polish pressure, (4) wafer presence/rotation failure, and (5) wafer break detection. To further illustrate this point, a second exemplary sensor system is described below in conjunction with FIGS. 4 and 5 comprising a flexible circuit including multiple flexible sensors of various types.

Figure 4:
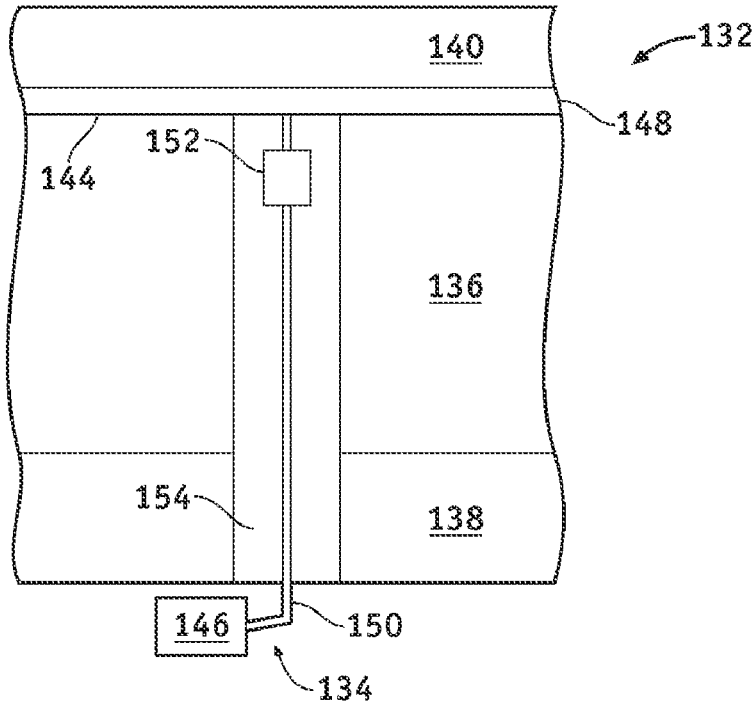
FIG. 4 is a cross-sectional view of a platen assembly including a sensor system in accordance with a second exemplary embodiment of the present invention.

FIG. 4 is a cross-sectional view of a platen assembly 132 and a sensor system 134. Platen assembly 132 is similar to platen assembly 61 described above in conjunction with FIGS. 1-3; platen assembly 132 includes a platen 136 and a bell 138. A polish pad 140 may be mounted (e.g., adhesively attached) to the upper surface (i.e., the support surface) 144 of platen 136. As was the case previously, sensor system 134 includes a sensor controller 146 and a flexible circuit 148, which is operatively coupled to controller 146 by way of a cable 150 having a connector 152. A channel 154 is provided through platen assembly 132 (e.g., from a lower surface of bell 138 to support surface 144 of platen 136) to accommodate cable 150. In one option, one or more components of sensor controller 146 are mounted to bell 138. In another option, a collar (not shown) is disposed within channel 154 in the manner described above in conjunction with FIG. 3. In yet another option, a collar is disposed within a channel in the polish manifold (not shown). Although shown as extending through the center of platen assembly 132, it should be appreciated that channel 154 may be disposed at any suitable location in platen assembly 132.

As was flexible circuit 106, flexible circuit 148 is disposed proximate surface 144 of platen 136. However, unlike flexible circuit 106, flexible circuit 148 does not reside within channel 154 provided through platen assembly 132. Instead, flexible circuit 148 is disposed between polish pad 140 and platen 136. For example, flexible circuit 148 may be disposed over, and be substantially contiguous with, support surface 144 of platen 136. As described in more detailed below, flexible circuit 148 may carry multiple flexible sensors, including one or more flexible induction coils of the type described above. A single cable 150 couples flexible circuit 148, and thus each of the flexible sensors included within flexible circuit 148, to sensor controller 146. As a result, only one channel 154 need be provided through platen assembly 132. Relative to sensor systems requiring the provision of multiple channels through the platen assembly, this significantly reduces the number of potential leak paths through the platen assembly and also decreases the likelihood of polish pad dimpling.

To help ensure that polish pad 140 presents a planar polishing surface to wafer 72 (FIG. 2), flexible circuit 148 preferably has a substantially constant thickness (i.e., circuit 148 is substantially flat). In addition, the planform shape of flexible circuit 148 is preferably similar (or identical) to that of polish pad 140 (e.g., flexible circuit 148 and polish pad 140 may have a circular form of a particular outer diameter), although this need not always be the case. As stated above, in the exemplary embodiment illustrated in FIG. 4, flexible circuit 148 is supported by and coupled to platen 136. For example, the lower surface of flexible circuit 148 may be adhesively attached to support surface 144 of platen 136. Similarly, the upper surface of flexible circuit 148 may be adhesively attached to the lower surface of pad 140. In this manner, flexible circuit 148 may be rolled onto support surface 144 prior to the installment of pad 140. Alternatively, flexible circuit 148 may first be attached to pad 140 and then the resulting two-layered body may be rolled onto support surface 144.

Figure 5:
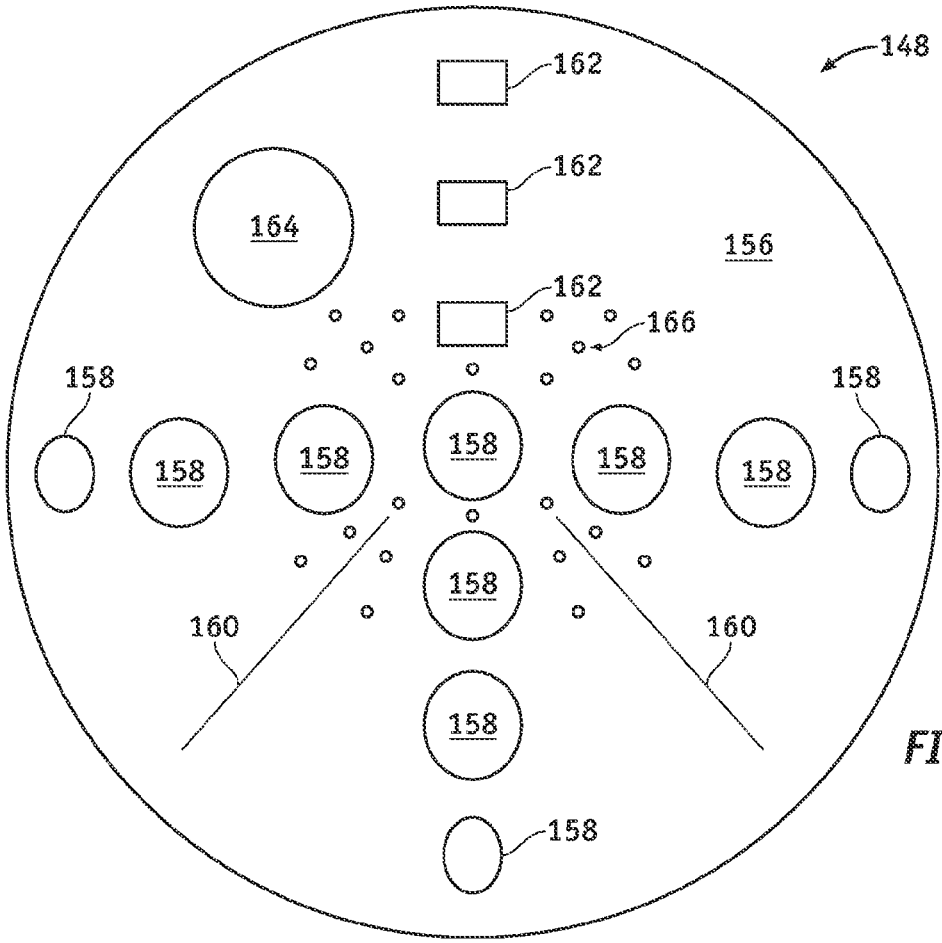
FIG. 5 is a top plan view of a flexible circuit including a plurality of flexible sensors that may be employed in the sensor system shown in FIG. 4.

FIG. 5 is a top-down plan view of flexible circuit 148. As can be seen, flexible circuit 148 includes a flexible substrate 156 carrying a plurality of flexible sensors of various types. In this example, flexible substrate 156 carries the following flexible sensors: (1) ten film thickness sensors 158, which may each take the form of a flexible induction coil; (2) two temperature sensors 160, which may each take the form of a metallic (e.g., copper) wire; (3) three pressure sensors 162; and (4) one wafer detection sensor 164, which may take the form of wound-wire or etched coil. A plurality of slurry holes 166 may also be provided through substrate 156 to facilitate the delivery of slurry from platen 136 to pad 140 in the well-known manner.

Flexible sensors suitable for use as sensors 158, 160, 162, and 164 are all generally known in the field of flexible circuits and are consequently not described in great detail here other than to note the following. First, as noted above, flexible coils 158 may be disposed at different radial locations on substrate 156 to monitor different annular zones along the front surface of the wafer. Also, the size of each flexible coil 158 may varied to adjust the dimensions of the zone monitored thereby. For example, as indicated in FIG. 5, the outer three coils of flexible coils 158 may have a reduced outer diameter (as compared to the inner coils 158, which are configured to measure the thickness of an inner portion of the wafer). In this manner, the outer three coils of flexible coils 158 may be utilized to monitor the thickness of a relatively small zone proximate the wafer's peripheral edge. Also, by tracking when the edge of wafer 72 passes over outer coils 158, sensor controller 146 may monitor the rotation of wafer 72 to determine if, for example, a rotational failure should occur. Furthermore, controller 146 may utilize wafer detection sensor 164 to determine whether wafer 72 is positioned proximate pad 140 by monitoring the flux within sensor 164 and identifying any significant changes indicative of the presence, or absence, of the wafer's metallic film.

The arrangement of the flexible sensors carried by flexible substrate 156 may be varied to suit a particular application or CMP system. For example, if platen assembly 132 rotates 180 degrees during the CMP process, flexible sensors 158, 160, 162, and 164 may be generally positioned on either half of substrate 156 as shown in FIG. 5. However, it should be appreciated that flexible circuit 148 may be employed in any CMP apparatus having a variety of components and employing any type of platen motion, including linear, rotational (180 degrees, 360 degrees, etc.), orbital, oscillatory, and so on. If, for example, the platen assembly was configured to rotate 90 degrees with respect to the wafer, it may be desirable to deploy a flexible sensor (e.g., a temperature sensor) over each pie-shaped quadrant of the platen.

Figure 6:
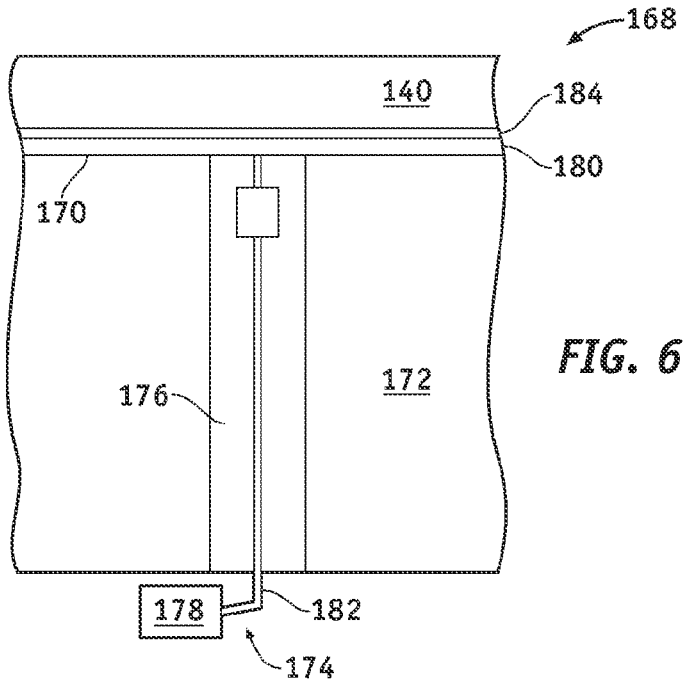
FIG. 6 is a cross-sectional view of a platen assembly including a sensor system in accordance with a third exemplary embodiment of the present invention.

There has thus been provided two exemplary embodiments of a sensor system and platen assembly employing a flexible circuit including one or more flexible sensors, which are in contact with the underside of the polish pad (e.g., adhesively coupled to the underside of the polish pad or to the top side of the platen). These examples notwithstanding, it should be appreciated that the flexible sensors need not be directly attached to the polish pad. This point is further illustrated in FIG. 6, which is a cross-sectional view of a platen assembly 168 including a polishing platen 172 and a sensor system 174. Platen 172 includes a channel 176 therethrough. Channel 176 extends to support surface 170 of platen 172, which supports polish pad 140 during the CMP process as described above. As was the case with sensor system 134 (FIG. 4), sensor system 174 includes a sensor controller 178, a flexible circuit 180 including at least one flexible sensor, and a cable 182 running within channel 176 and connecting controller 178 to flexible circuit 180. Flexible circuit 180 resides proximate support surface 170. However, in this particular example, flexible circuit 180 does not directly contact polish pad 140. Instead, a cover piece 184 is placed over flexible circuit 180 between circuit 180 and pad 140. Cover piece 184 may be formed from the same material as is polishing platen 136 and may be removably coupled to flexible circuit 180 by way of, for example, an adhesive. Alternately, cover piece 184 may be a sub-pad located under the polish pad. In this manner, cover piece 184 may guard flexible circuit 180 from physical damage while still permitting circuit 180 to be readily accessed.

In view of the above, it should be appreciated that a platen assembly has been provided that includes sensor system employing at least one flexible circuit capable of monitoring various characteristics of the CMP process, including film thickness, polish pressure, temperature, wafer breakage, wafer presence, and rotation failure. Furthermore, the flexible circuit (or circuits) is resistant to CMP processing conditions (e.g., vibration, moisture) and may be replaced or repaired without disassembly of the entire platen assembly. In certain embodiments, the sensor system only requires the provision of a single channel through the platen assembly, which reduces the likelihood of slurry leakage and pad dimpling.

Figure 7:
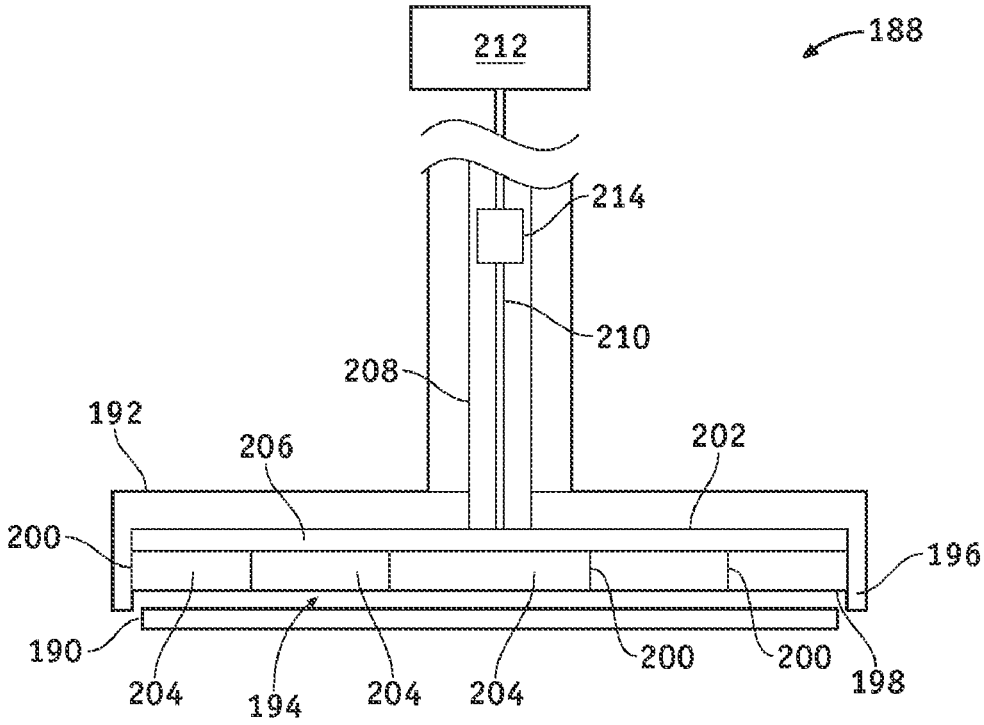
FIG. 7 is a cross-sectional view of a work piece carrier including a sensor system in accordance with a fourth exemplary embodiment of the present invention.

Although the foregoing has described exemplary embodiments of a sensor system wherein at least one flexible circuit is deployed near the supporting surface of a platen assembly, it should be understood that the flexible circuit may be positioned at any location within the CMP apparatus suitable for measuring a characteristic of the wafer (e.g., film thickness) or a parameter of the CMP process (e.g., polish pressure). For example, the flexible circuit may be positioned within or mounted upon the carrier head (e.g., disposed proximate the bladder) and used to monitor film thickness, polish pressure, wafer presence, wafer breakage and/or another characteristic of the CMP process. To further illustrate this point, FIG. 7 provides a cross-sectional view of a carrier head 188 and a wafer 190. Carrier head 188 is similar to carrier head 58 described above in conjunction with FIG. 2; e.g., carrier head 188 includes a carrier head housing 192, a bladder 194 sealingly attached to a lower portion of housing 192, and a retaining ring 196. Bladder 194 includes a flexible diaphragm 198, which contacts wafer 190 during polishing, and a plurality of annular ribs 200, which extends away from flexible diaphragm 198 and sealingly engages an inner surface 202 of housing 192 to form a plurality of pressurizable plenums 204. As was the case previously, each plenum 204 is fluidly coupled to a pressure regulator by way of a pneumatic passage (not shown in FIG. 7 for clarity). In contrast to carrier head 58, work piece carrier head 186 further includes a flexible circuit 206 having at least one flexible sensor formed therein, which is capable of monitoring various characteristics of the CMP process (e.g., film thickness, polish pressure, etc.). Flexible circuit 206 is preferably disposed proximate bladder 194. Specifically, flexible circuit 206 may reside between inner surface 202 and bladder 194 as indicated in FIG. 7 (e.g., flexible circuit 206 may be adhesively attached to inner surface 202). A channel 208 extends through a portion of housing 192 (e.g., the spindle) to accommodate a cable 210, which operatively couples flexible circuit 206 to a sensor controller 212. If desired, cable 210 may be provided with a connector 214 to facilitate the detachment of flexible circuit 206 from controller 212. Flexible circuit 206 may also include a plurality of apertures (not shown), which permits bladder ribs 200 to be sealingly coupled to inner surface 202 of carrier head 186.

Figure 8:
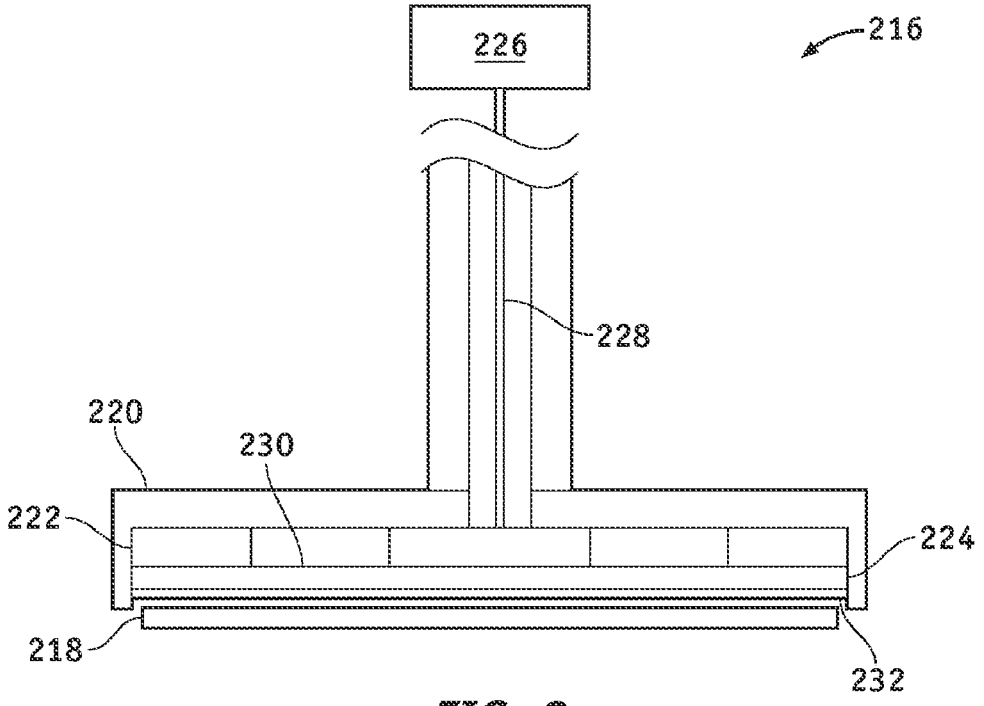
FIG. 8 is a cross-sectional view of a work piece carrier including a sensor system in accordance with a fifth exemplary embodiment of the present invention.

FIG. 8 is a cross-sectional view of a work piece carrier head 216 and a wafer 218 in accordance with a fifth exemplary embodiment of the present invention. Carrier head 216 is similar to carrier head 188 previously described in conjunction with FIG. 7; e.g., carrier head 216 includes a carrier housing 220 having a bladder 222 sealingly coupled thereto. Work piece carrier head 216 is further equipped with a flexible circuit 224, which includes at least one flexible sensor formed therein capable of monitoring one or more characteristics of the CMP process as previously described. Flexible circuit 224 may be operatively coupled to a sensor controller 226 via cable 228. In this particular example, flexible circuit 224 resides proximate bladder 194. More specifically, flexible circuit 224 is disposed over diaphragm 230 of bladder 194. Flexible circuit 224 may be attached to diaphragm 230 and/or housing 220 by way of an adhesive or other suitable means. Work piece carrier head 216 optionally includes a cover piece 232, which is disposed over flexible circuit 224 (e.g., removably attached to flexible circuit 224 and/or housing 222 by way of, for example, an adhesive). Cover piece 232 contacts wafer 218 during the CMP process and is thus preferably formed from a pliable material (e.g., rubber) that may flex along with diaphragm 230.

Although the foregoing exemplary embodiments have been described in conjunction with a particular type of CMP apparatus (i.e., a CMP apparatus of the type manufactured by Novellus Systems, Inc.), it should understood that the invention is by no means limited to a particular type of CMP apparatus and may be utilized in conjunction with a wide variety of CMP apparatuses, including those produced by other manufacturers. Furthermore, while at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A platen assembly configured to support a polish pad utilized to planarize a work piece, the platen assembly comprising:

a polish platen having a first surface for supporting the polish pad and having a channel therethrough; and a sensor system, comprising:

a sensor controller;

a flexible circuit operatively coupled to said sensor controller, said flexible circuit including a first flexible sensor disposed over said first surface, the flexible circuit having an outer diameter substantially equivalent to the outer diameter of the polish pad, having a planform shape substantially identical to the planform shape of the polish pad, and having a substantially constant thickness to ensure that the polish pad, when disposed over the flexible circuit, presents a substantially planar polishing surface to the work piece; and a cable extending through said channel to couple said flexible circuit to said sensor controller.

2. A platen assembly according to claim 1 wherein said cable further comprises a connector residing within said channel and configured to be manually accessed through said first surface of said polish platen to permit detachment of said flexible circuit from said sensor controller.

3. A platen assembly according to claim 1 wherein said flexible circuit resides at least partially within said channel.

4. A platen assembly according to claim 3 wherein said flexible circuit is adapted to be adhesively attached to a surface of the polish pad.

5. A platen assembly according to claim 3 wherein said first flexible sensor is a flexible induction coil.

6. A platen assembly according to claim 1 wherein said flexible circuit is disposed between said polish platen and the polish pad.

7. A platen assembly according to claim 6 wherein said flexible circuit substantially contiguous with said first surface.

8. A platen assembly according to claim 6 wherein said flexible circuit is adapted to be adhesively attached to at least one of said first surface and a surface of the polish pad.

9. A platen assembly according to claim 6 wherein said first flexible sensor is configured to measure at least one of the following characteristics: film thickness, temperature, polish pressure, wafer presence, wafer breakage, and wafer rotation.

10. A platen assembly according to claim 1 further comprising a plurality of slurry holes formed through said flexible circuit.

11. A platen assembly configured to support a polish pad utilized to planarize a work piece, the platen assembly comprising:

a polish platen having a first surface for supporting the polish pad, a second surface, and a channel extending from said second surface to said first surface;

a sensor system, comprising:

a sensor controller;

a flexible circuit operatively coupled to said sensor controller, said flexible circuit including a first flexible sensor disposed over said first surface, the flexible circuit having an outer diameter substantially equivalent to the outer diameter of the polish pad, having a planform shape substantially identical to the planform shape of the polish pad, and having a substantially constant thickness to ensure that the polish pad, when disposed over the flexible circuit, presents a substantially planar polishing surface to the work piece; and a cable disposed within said channel and coupling said sensor controller to said flexible circuit;

a collar disposed within said channel and guiding said cable therethrough; and an O-ring disposed between said collar and an inner surface of said channel.

12. A platen assembly according to claim 9 wherein said flexible circuit comprises a flexible substrate carrying a first and second flexible sensor and having a plurality of slurry holes formed therethrough.

13. A platen assembly according to claim 9 further comprising a cable extending through a polish platen and operatively coupling each of said first and second sensor to said sensor controller.

14. A platen assembly configured to support a polish pad, the platen assembly comprising:

a polish platen having a first surface for supporting the polish pad and having a channel therethrough; and a sensor system, comprising:

a sensor controller;

a flexible circuit operatively coupled to said sensor controller, said flexible circuit including a first flexible sensor disposed between said polish platen and the polish pad when the polish pad is supported by said polish platen; and a cable extending through said channel to couple said flexible circuit to said sensor controller.

15. A platen assembly according to claim 14 wherein said flexible circuit further contacts and is adhesively attached to the underside of the polish pad when the polish pad is disposed over the flexible circuit.

16. A platen assembly according to claim 14 wherein said flexible circuit comprises a flexible substrate, and wherein said first flexible sensor comprises a flexible induction coil carried by the flexible substrate.

* * * * *

UNITED STATES PATENT AND TRADEMARK OFFICE

CERTIFICATE OF CORRECTION

PATENT NO. : 7,887,392 B2
APPLICATION NO. : 11/758797
DATED : February 15, 2011
INVENTOR(S) : Paul M. Franzen It is certified that error appears in the above-identified patent and that said Letters Patent is hereby corrected as shown below:

Column 10, line 8 - delete the word "first"

Column 10, line 19 - delete the word "first"

Signed and Sealed this
Twelfth Day of April, 2011

David J. Kappos

David J. Kappos
*Director of the United States Patent and Trademark Office*